US005794578A

United States Patent [19]

Strauss et al.

[11] Patent Number: 5,794,578

[45] Date of Patent: Aug. 18, 1998

[54] VALVE TIMING CONTROL APPARATUS

[75] Inventors: Andreas Strauss, Herzogenaurach; Jochen Auchter, Aurachtal; Johannes Meyer, Karlsfeld, all of Germany

[73] Assignee: Ina Wälzlager Schaeffler oHG, Herzogenaurach, Germany

[21] Appl. No.: 960,246

[22] Filed: Oct. 29, 1997

[30] Foreign Application Priority Data

Nov. 6, 1996 [DE] Germany ..... 196 45 688.6

[51] Int. Cl.[6] ..... F01L 1/344

[52] U.S. Cl. ..... 123/90.17; 123/90.31

[58] Field of Search ..... 123/90.15, 90.17, 123/90.31, 90.33, 90.34; 74/567, 568 R; 464/1, 2, 160

[56] References Cited

U.S. PATENT DOCUMENTS

| | | | |
|---|---|---|---|
| 5,111,780 | 5/1992 | Hannibal | 123/90.17 |
| 5,263,442 | 11/1993 | Hara | 123/90.17 |
| 5,509,384 | 4/1996 | Schmid | 123/90.17 |
| 5,566,651 | 10/1996 | Strauss et al. | 123/90.17 |
| 5,657,671 | 8/1997 | Morii | 123/90.17 |

FOREIGN PATENT DOCUMENTS

| | | |
|---|---|---|
| 40 24 057 C1 | 9/1991 | Germany . |
| 195 06 751 A1 | 8/1996 | Germany . |
| 195 25 837 A1 | 1/1997 | Germany . |

*Primary Examiner*—Weilun Lo
*Attorney, Agent, or Firm*—Henry M. Feiereisen

[57] ABSTRACT

A valve timing control apparatus of an internal combustion engine includes an output element having a central bore and in mesh with an adjusting member which reciprocates between two axially spaced end positions, thereby defining two pressure compartments which are fluidly sealed from one another. An oil guide bush is received in the central bore of the output element and projects in a bore of the camshaft or the component securely fixed thereto. A first fluid passageway is formed between an outer surface area of the guide bush and an inner surface area of the driven element for conducting hydraulic medium to one of the pressure compartments, and a second passageway is formed interiorly of the guide bush for conducting hydraulic medium to the other one of the pressure compartments. The guide bush is securely fixed to a screw fastener and so configured as to allow a connection from the interior of the guide bush to the other one of the pressure compartments. By separating the unit of guide bush and screw fastener from the valve timing control apparatus, the driven element of the valve timing control apparatus now possesses only a very small axially projecting length so that no additional structural space is required between the outer and the first end wall of the cylinder head. Only after installing the apparatus together with other components of the control mechanism vertically in the form of a cartridge is the screw fastener with attached oil guide bush inserted for securement of the apparatus to the camshaft.

17 Claims, 2 Drawing Sheets

VALVE TIMING CONTROL APPARATUS

BACKGROUND OF THE INVENTION

The invention generally relates to a valve timing control apparatus for adjusting a rotational relation between a camshaft and a timing pulley of an internal combustion engine, thereby allowing improvements with regard to torque, performance, exhaust gas emission, idling behavior and fuel consumption.

A valve timing control apparatus is known e.g. from German Pat. No. 40 24 057 and illustrated for ease of understanding in FIG. 5 which depicts two variations. The valve timing control apparatus generally includes a piston 34 which is hydraulically acted upon on both sides for movement between two end positions, thus defining two pressure compartments 40, 41. The piston 34 cooperates with a driven element 37 which is connected to the camshaft 1. As shown in particular in the variation depicted in the lower half of FIG. 5, the driven element 37 defines a central bore 42 and includes a collar 50 for supporting one end of an oil guide bush 43. The other end of the guide bush 43 is supported by a diametrical reduction of the bore 42 in the form of a bushing 47. The guide bush 43 separates inside the bore 42 a first exterior passage 44 which communicates with the pressure compartment 40 and is connected to a bore 23 in the camshaft 1. A second passage 46 is formed inside the guide bush 43 and communicates with the pressure compartment 41. A screw fastener (not shown) is guided through the driven element 37 and the guide bush 43 to non-rotatably secure the valve timing control apparatus directly to the camshaft 1 or indirectly via a interposed component that is securely fixed to the camshaft 1. It is noted that the description of the conventional valve timing control apparatus of FIG. 5 is limited to those parts which are relevant in conjunction with the present invention for sake of simplicity.

Prior to attachment of the valve timing control apparatus to the camshaft 1, the guide bush 43 is fixed to the collar 50 of the driven element 37 which is inserted into the camshaft 1 by means of a sleeve 51 of an axial length denoted by reference character $\ddot{U}_1$. As shown in FIG. 5, the guide bush 43 projects with a major portion of its axial length beyond the driven element 37, as denoted by reference character $\ddot{U}_2$. In the event, a valve timing control apparatus of this type is intended to be inserted together with the guide bush and other essential components of the control mechanism in a vertical alignment into the cylinder head between an outer wall and a first end wall of the cylinder head in axial direction, the substantial projecting length $\ddot{U}_{ges}$ of the oil guide bush 43 and the axial length of the sleeve 51 causes considerable problems since only a very restricted structural space is available between the outer wall and the first end wall of the cylinder head. Moreover, considerable space must be provided for allowing tilting motions during axial insertion of the apparatus together with the sleeve and guide bush.

SUMMARY OF THE INVENTION

It is thus an object of the present invention to provide an improved valve timing control apparatus, obviating the afore-stated drawbacks.

In particular, it is an object of the present invention to provide an improved valve timing control apparatus which allows simple attachment thereof to other components of the control mechanism in the form of a cartridge between an outer wall and a first end wall of the cylinder head in axial direction, without significantly enlarging the structural space in the axial direction.

These objects, and others which will become apparent hereinafter, are attained in accordance with the present invention by providing an output element, an adjusting member in mesh with the output element and reciprocating between two axially spaced end positions so as to define two pressure compartments which are fluidly sealed from one another, an oil guide bush received in a central bore of the output element and projecting into a bore of the camshaft or component securely fixed thereto, fluid passageways conducting a hydraulic fluid to the pressure compartments and including a first passageway positioned between an outer surface area of the guide bush and an inner surface area of the driven element for conducting hydraulic medium to one of the pressure compartments, and a second passageway formed interiorly of the guide bush for conducting hydraulic medium to the other one of the pressure compartments, and a screw fastener extending through the guide bush for non-rotatably securing the driven element to the camshaft, with the guide bush being so securely fixed to the screw fastener as to allow a connection from the interior of the guide bush to the other one of the pressure compartments.

Preferably, the oil guide bush is provided interiorly with at least one ring-like element or collar for effecting the securement to the screw fastener, with the ring-like element being formed with at least one aperture to enable flow of hydraulic fluid out of the interior of the guide bush.

As the guide bush, which projects axially outwards beyond the driven element, is secured to the screw fastener, the axially projecting length of the valve timing control apparatus is reduced. Thus, there is no need to increase the distance between the outer wall and the first end wall of the cylinder head beyond the distances provided in conventional constructions so that the valve timing control apparatus can be inserted in the form of a cartridge together with further components of the control mechanism vertically between the walls, whereby the valve timing control apparatus is suitably centered by the support of the projecting length of the driven element upon the camshaft. After insertion of the valve timing control apparatus together with the other components into the cylinder head from atop, the screw fastener together with the attached guide bush can be easily guided through an appropriate recess of the outer cylinder wall and the bore of the driven element and so bolted to the camshaft as to prevent the driven element from rotating relative to the camshaft.

A valve timing control apparatus according to the invention can be used in a wide variety of camshaft adjusting systems, such as rotary piston adjusters or vane-type adjusters, radial piston adjusters or axial piston adjusters.

The oil guide bush may also be secured to the screw fastener via a ring-like member made as a separate element and secured to a camshaft-distal end of the guide bush. The ring-like element is suitably formed, as stated above, with apertures or bores for conduction of hydraulic medium flowing along an inside wall surface of the guide bush toward one of the end faces of the adjusting piston. However, the ring-like element may also be configured in one piece with the guide bush in the form of a radially inwardly directed collar having incorporated therein appropriate passages for hydraulic medium. Although the provision of a ring-like member or collar is preferred, it is noted that the guide bush may also be directly mounted on the screw fastener so that the ring-like member may be omitted altogether while still attaining the advantages as described above.

According to another feature of the present invention, the camshaft-distal end face of the oil guide bush together with the head of the screw fastener and the driven element defines an annular space from which hydraulic fluid can be routed through at least one radial bore in the driven element to one pressure compartment of the adjusting member. The annular space is supplied through the aperture in the ring-like member with hydraulic fluid which is fed into the second passage along the inside wall surface of the guide bush from a radial bore of the camshaft or of the component fixed on the camshaft.

Preferably, the camshaft or component fixed thereto has a counterbore of enlarged diameter for receiving the axially projecting length of the driven element.

Advantageously, the valve timing control apparatus according to the present invention is applicable even in the event the adjusting piston is acted upon hydraulically in only one direction of adjustment. The short axially projecting length of the driven element received in the counterbore of the camshaft effects a superior centering of the valve timing control apparatus relative to the camshaft, without significantly increasing the demand for greater structural space in axial direction.

It is still another object of the present invention to provide an improved method of securement a valve timing control apparatus to the camshaft.

This object can be attained in accordance with the present invention by securing a ring-like element at one axial end of an oil guide bush, placing the guide bush with the ring-like element onto a screw fastener, subsequently, or preceding the securing step, so positioning the valve timing control apparatus on the camshaft that a short section of the camshaft is able to receive an axial end of the valve timing control apparatus, and inserting the screw fastener together with the attached oil guide bush through a bore of the valve timing control apparatus such that the screw fastener bears with its head at least indirectly against an end face of the valve timing control apparatus while at same time being threadably engaged with the camshaft or component fixed thereto.

When dismantling the valve timing control apparatus together with the control mechanism, it is advantageous to leave the oil guide bush connected to the screw fastener because otherwise problems may be encountered when removing the cartridge comprised of the control mechanism and the valve timing control apparatus vertically out of the cylinder head.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 2:
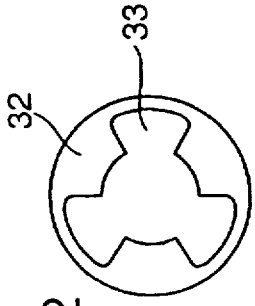
FIGS. 2 to 4 show various configurations of a ring-like member for use in the valve timing control apparatus of FIG. 1.

Throughout all the Figures, the same or corresponding elements are generally indicated by the same reference numerals.

Figure 1:
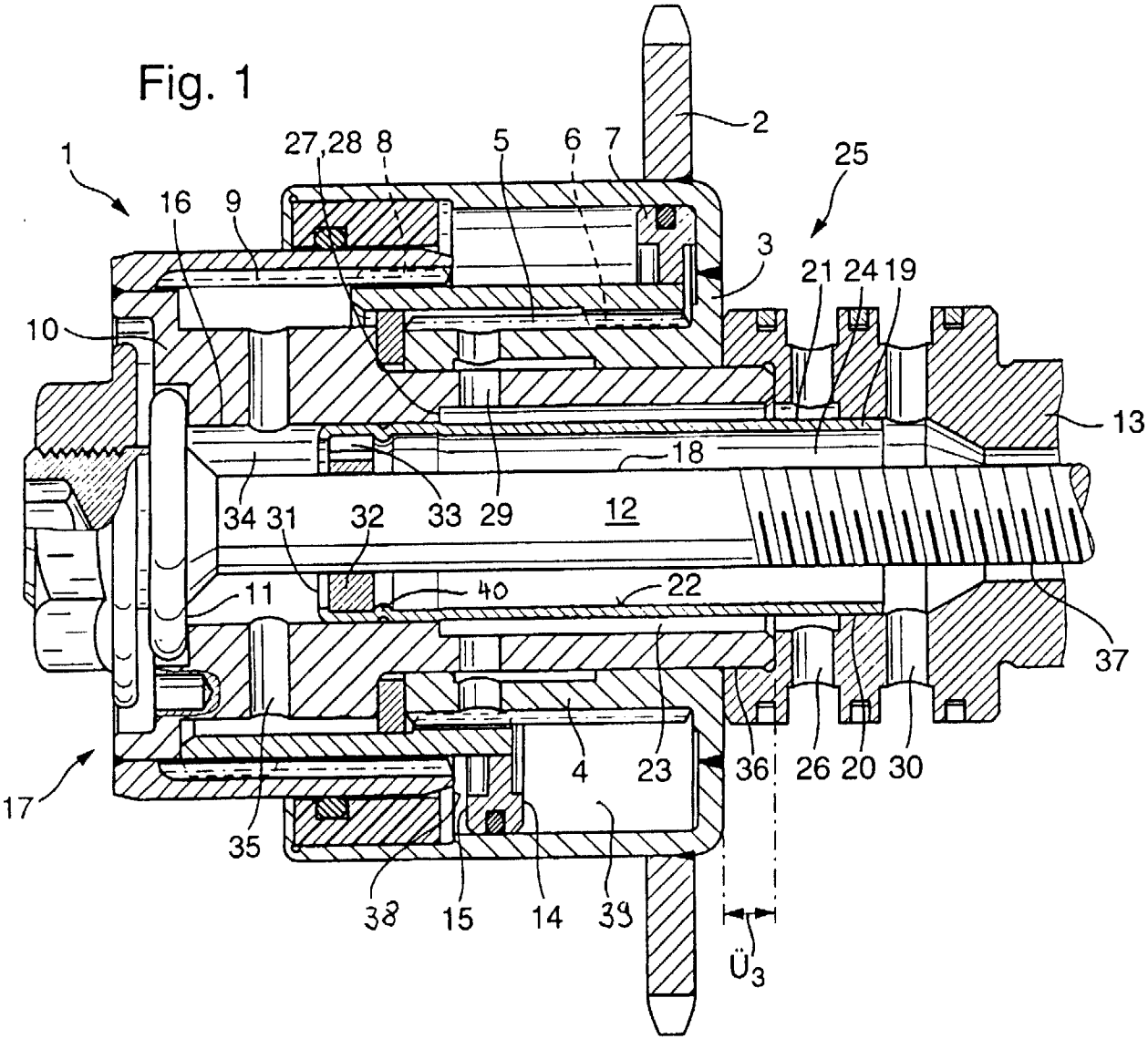
FIG. 1 is a longitudinal cross-section of one embodiment of a valve timing control apparatus according to the present invention.
Figure 5:
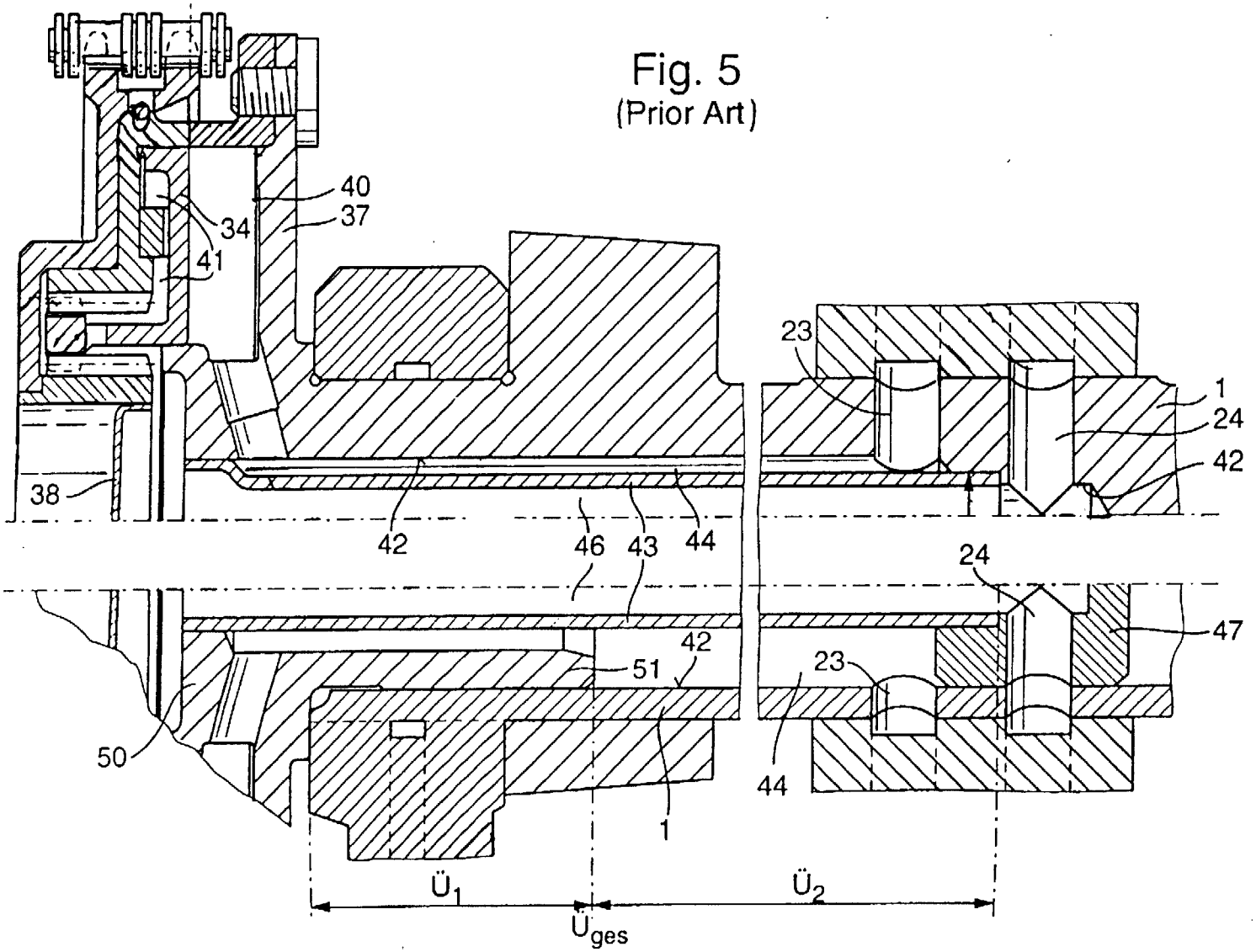
Fig. 5 (Prior Art)
FIG. 5 is a cross sectional view of a conventional valve timing control apparatus.

Turning now to the drawing, and in particular to FIG. 1, there is shown a valve timing apparatus according to the present invention, generally designated by reference numeral 1 for adjusting a rotational relation between a camshaft 13 and a timing pulley 2 of an internal combustion engine and to thereby adjust the valve timing of gas exchange valves (not shown). For the sake of simplicity, the valve timing control apparatus will be described hereinafter only in connection with an axial piston adjuster; However, persons skilled in the art will understand that the valve timing control apparatus according to the present invention is equally applicable for use in other camshaft adjusting systems, such as rotary piston adjusters, vane-type adjusters or radial piston adjusters.

The camshaft 13 is rotatably supported in a cylinder head, with the valve timing control apparatus 1 being arranged in driving relationship between the camshaft 13 and the timing pulley 2. A timing belt (not shown) is in mesh with the timing pulley 2 to transmit the driving force of the engine via a crankshaft (not shown) to the timing pulley 2 and thus to the camshaft 13 in order to operate the gas exchange valves.

The timing pulley 2 is of hollow cylindrical configuration and is connected radially inwardly to a driving element 3 which is formed with an axial sleeve 4. Outer helical gear teeth 5 are provided on the axial sleeve 4 and capable of meshing complementary inner gear teeth 6 of an adjusting piston 7 which is axially displaceable by a hydraulic medium to separate two pressure compartments 38, 39 demarcated by end surfaces or faces 15, 14, respectively, of the adjusting piston 7. The adjusting piston 7 is formed with outer gear teeth 8 which are adapted for engagement with radially inner gear teeth 9 of a driven element 10. The driven element 10 is secured via a head 11 of a screw fastener 12 to the camshaft 13 and is thus secured against rotation relative thereto. Upon supply of hydraulic medium to one of the end faces 14 or 15 of the adjusting piston 7, the timing pulley 2 is rotated relative to the camshaft 13 via meshing gear teeth 5, 9 and gear teeth 6, 8 to effect the advantages in conjunction with internal combustion engines with regard to torque, performance, exhaust gas emission, idling behavior and fuel consumption.

The screw fastener 12 is inserted from a camshaft-distal end 17 of the driven element 10 through a central bore 16 of the driven element 10. Concentrically surrounding the shank 18 of the screw fastener 12 is an oil guide bush 19 having opposite axial ends bearing sealingly against the bore 16 and against a bore 20 of the camshaft 13. The oil guide bush 19 separates with its outer surface area 21 a first ring-shaped exterior passage 23 within the central bore 16, and demarcates with its inner surface area 22 an interior annular passage 24 to enable supply of hydraulic medium to the pressure compartments 38, 39 and thus end faces 14, 15 of the adjusting piston 7. Hydraulic medium is fed to the first passage 23 via a radial bore 26 arranged in one end 25 of the camshaft 13. At its camshaft-distal end, the first passage 23 is bounded by an annular surface 27 formed by a shoulder 28 of the driven element 10 and communicates via a radial intersecting bore 29 of the driven element 10 in the region of the annular surface 27 with the pressure compartment 38 and end face 14 of the adjusting piston 7.

Figure 3:
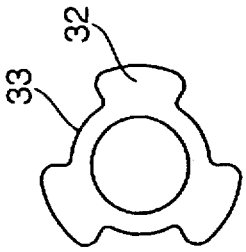
Figure 4:
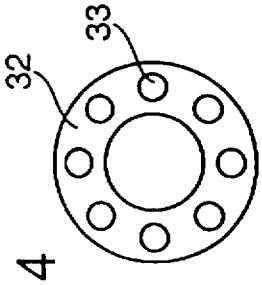

The second passage 24 is supplied with hydraulic medium in the region of the camshaft end 25 via a further bore 30 formed radially in the camshaft 13. In the region of its camshaft-distal end 31, the oil guide bush 19 accommodates a ring-like element 32 which is securely held in place between the end 31 and a crimp 40 and is provided for securing the oil guide bush 19 to the screw fastener 12. This ring-like element 32 is formed with circumferentially spaced apertures 33 which can be made, for example, in the form of bores as indicated in FIG. 4 or in the form of recesses as shown in FIGS. 2 and 3. These apertures 33 allow hydraulic medium to flow from the second passage 24 into an annular space 34 arranged in the bore 16 between the guide bush end 31 and the head 11 of the screw fastener 12. This annular space 34 is thus defined radially inwardly by the shank 18 of the screw fastener 12, radially outwardly by the bore 16 of the driven element 10 and axially in camshaft direction by the end face 31 and in the opposite direction by the head 11 of the screw fastener 12. Hydraulic medium can be routed to the pressure compartment 39 and thus end face 15 of the adjusting piston 7 from the annular space 34 through a bore 35 radially intersecting the driven element 10.

According to the invention, the oil guide bush 19 is securely fixed to the screw fastener 12 by means of the ring-like element 32, as shown in FIG. 1, with the screw-fastener 12 being properly aligned thereby in the axial direction. Thus, the oil guide bush 19 does not form an integral part of the valve timing control apparatus 1 during assembly thereof on the camshaft 13. As a result, the valve timing control apparatus 1 exhibits only a very small axially projecting length $\ddot{U}_3$ beyond the driven element 10 in the region of the camshaft 13, with this small projecting length $\ddot{U}_3$ enabling insertion of the entire valve timing control apparatus 1 (without the oil guide bush 19 but with further components of the control mechanism such as drive chain, chain tensioner etc.) vertically in the form of a cartridge between an outer wall and a first end wall of the cylinder head (not shown), as viewed in axial direction, and to fix the valve timing control apparatus 1 in place as a whole on the cylinder head. The attachment of the valve timing control apparatus 1 is effected in the area of the projecting length $\ddot{U}_3$ of the driven element 10 which is received in an enlarged diametrical section 36 of the camshaft 13.

Only after assembly of these end components of the engine in the manner of a cartridge, the screw fastener 12 with the pre-assembled oil guide bush 19 is introduced through an appropriate aperture in the outer wall of the cylinder head and further into the bore 16 of the driven element 10 whereafter the driven element 10 is fixed by the head 11 of the screw fastener 12 to the camshaft 13, whereby the bore 20 of the camshaft 13 is formed with an internal thread (not shown) which complements the thread 37 of the screw fastener 12.

While the invention has been illustrated and described as embodied in a valve timing control apparatus, it is not intended to be limited to the details shown since various modifications and structural changes may be made without departing in any way from the spirit of the present invention.

What is claimed as new and desired to be protected by Letters Patent is set forth in the appended claims:

1. Apparatus (1) for varying valve timings in an internal combustion engine, said apparatus (1) is arranged between a control gear teeth of at least one camshaft (13) mounted in a cylinder head and a timing pulley (2) in driving relationship with the camshaft (13), the apparatus (1) comprising a hydraulically displaceable adjusting member (7) which cooperates with a driven element (10) which is connected to the camshaft (13) and in whose central bore (16) one end of an oil guide bush (19) extends, a second end of the oil guide bush (19) being inserted into a bore (20) of an end (25) of the camshaft (13) nearer the apparatus (1), a first passage (23) being formed on an outer peripheral surface (21) of the oil guide bush (19) facing the driven element (10) and the camshaft (13), and a second passage (24) being formed on an inner peripheral surface (22) of the oil guide bush (19), each of said passages (23, 24) serves to route hydraulic medium to one of two end surfaces (14, 15) of the adjusting member (7), the apparatus (1) being non-rotatably fixed, to the camshaft (13) by a central screw means (12) with cooperation of the driven element (10) from whose camshaft-remote end (17) the screw means (12) extends axially through the oil guide bush (19), characterized in that the oil guide bush (19) is secured to the screw means (12) by at least one radially inwards pointing ring-like element (32).

2. The apparatus of claim 1 wherein the ring-like element (32) is made as a separate element and fixed on a camshaft-distal end (31) of the oil guide bush (19), said ring-like element (32) being formed with at least one axially extending aperture (33).

3. The apparatus of claim 2 wherein the ring-like element (32) is formed with a plurality of circumferentially spaced apertures (33) made in the form of bores or recesses of any shape.

4. The apparatus of claim 1 wherein the adjusting member (7) is an axially displaceable adjusting piston which includes a first helical gear teeth section (6) and a second helical gear teeth section (8), said first helical gear teeth section (6) cooperating with complementary gear teeth (5) of a driving element (3) connected to the timing pulley (2), and said second helical gear teeth section (8) cooperates with gear teeth (9) of the driven element (10) which is connected to the camshaft (13).

5. The apparatus of claim 4 wherein the first and second helical gear teeth sections are oppositely oriented.

6. The apparatus of claim 2 wherein an annular space (34) is defined axially inwardly by the end (31) of the oil guide bush (19), axially outwardly by a head (11) of the screw means (12), radially outwardly by the bore (16) of the driven element (10) and radially inwardly by the screw means (12), from which annular space (34) hydraulic medium can be routed through at least one radial bore (35) of the driven element (10) to one end face (15) of the adjusting member (7), said annular space (34) being supplied through the aperture (33) with hydraulic medium which is fed into the second passage (24) on the inner peripheral surface (22) of the oil guide bush (19) through a first radial bore (30) of the camshaft (13).

7. The apparatus of claim 2 wherein the camshaft (13) is formed with a first radial bore (30) and a further radial bore (26) which is arranged axially nearer the apparatus (1) than the first radial bore (30) and communicates with the first passage (23) on the outer peripheral surface (21) of the oil guide bush (19), said first passage (23) being defined axially towards the apparatus (1) by an annular surface (27) of a radially inwards pointing shoulder (28) of the driven element (10) with whose bore (16) the oil guide bush (19) is in sealing contact, and said passage (23) leading to a second end surface (14) of the adjusting member (7) through at least one bore (29) intersecting the driven element (10) which is arranged in front of an annular space in the camshaft direction.

8. The apparatus of claim 1 wherein the bore (20) of the camshaft (13) has a section (36) of enlarged diameter which receives a small projecting length ($\ddot{U}_3$) of the driven element (10).

9. A valve timing control apparatus for adjusting a rotational relation between at least one camshaft and a timing pulley of an internal combustion engine, comprising, a driven element having a central bore;

an adjusting member in mesh with the driven element and reciprocating between two axially spaced end positions and defining two pressure compartments which are fluidly sealed from one another;

an oil guide bush received in the central bore of the driven element and projecting in a bore of the camshaft;

fluid passageway means for conducting a fluid to the pressure compartments, said fluid passageway means including at least one passageway selected from the group consisting of a first passageway positioned between an outer surface area of the guide bush and an inner surface area of the driven element for conducting hydraulic medium to one of the pressure compartments, and a second passageway formed interiorly of the guide bush for conducting hydraulic medium to the other one of the pressure compartments; and a screw fastener extending through the guide bush for non-rotatably securing the driven element to the camshaft, said guide bush being securely fixed to the screw fastener and so configured as to allow a fluid connection from the interior of the guide bush to the other one of the pressure compartments.

10. Apparatus of claim 9 wherein the camshaft has a counterbore of greater diameter for receiving an axially projecting length of the driven element.

11. The apparatus of claim 10, and further comprising at least one collar for securing the guide bush to the screw fastener.

12. The apparatus of claim 11 wherein the collar is a separate element which is secured to a camshaft-distal end of the guide bush, said collar being formed with at least one axial aperture.

13. The apparatus of claim 11 wherein the collar is formed with a plurality of circumferentially spaced apertures in the form of bores or recesses of any shape.

14. The apparatus of claim 10 wherein the adjusting member is formed by an axially displaceable piston formed with a first helical gear teeth section in mesh with a complementary gear teeth section of a driving element connected to the timing pulley, and a second helical gear teeth section in mesh with a gear teeth section of the driven element.

15. The apparatus of claim 14 wherein the first and second gear teeth sections are oppositely oriented.

16. The apparatus of claim 12 wherein the screw fastener is formed with a camshaft-distal head, said head together with the camshaft-distal end of the guide bush and the driven element bound an annular space which communicates with at least one radial bore in the driven element for conduction of hydraulic fluid to one pressure compartment, said annular space communicating with the second passage via the aperture for supply of hydraulic fluid from a radial bore of the camshaft.

17. The apparatus of claim 15 wherein the camshaft is formed with a second radial bore disposed closer to the driven element next to the first bore, said second bore communicating with the first passage, said driven element being formed interiorly with a shoulder for bounding the first passage in axial direction and having formed therein at least one intersecting bore in communication with the first passage for connection to the other one of the pressure compartments, said guide bush being in sealing contact with respect to the bore of the driven element.

* * * * *